US010048053B2

(12) United States Patent
Klein

(10) Patent No.: US 10,048,053 B2
(45) Date of Patent: Aug. 14, 2018

(54) BLADDER FOR TAMPING EXPLOSIVES

(71) Applicant: Global Assets Integrated, LLC, Las Vegas, NV (US)

(72) Inventor: Avner Klein, Las Vegas, NV (US)

(73) Assignee: Global Assets Integrated, LLC, Las Vegas, NV (US)

( * ) Notice: Subject to any disclaimer, the term of this patent is extended or adjusted under 35 U.S.C. 154(b) by 0 days.

(21) Appl. No.: 14/927,415

(22) Filed: Oct. 29, 2015

(65) Prior Publication Data

US 2017/0122715 A1 May 4, 2017

(51) Int. Cl.
*F42D 1/20* (2006.01)

(52) U.S. Cl.
CPC ..... *F42D 1/20* (2013.01)

(58) Field of Classification Search
CPC ..... F42D 1/08; F42D 1/14; F42D 1/16; F42D 1/18; F42D 1/20; F42D 1/22; F42D 1/24
USPC ..... 102/304, 314, 323, 324; 86/20.15
See application file for complete search history.

(56) References Cited

U.S. PATENT DOCUMENTS 232,640 A * 9/1880 Hallock ..... F42D 5/00 102/301
4,282,812 A * 8/1981 Forgey ..... F42B 3/26 102/318
4,369,711 A * 1/1983 Leader ..... F42B 3/087 102/313
4,628,819 A * 12/1986 Backofen, Jr. ..... F42B 3/28 102/303
4,669,641 A * 6/1987 Holmes ..... B65D 55/16 215/306
4,836,079 A * 6/1989 Barrett ..... F42D 5/045 102/303
7,819,063 B1 * 10/2010 Lehman ..... B26F 3/04 102/301
8,006,621 B1 * 8/2011 Cherry ..... B26F 3/04 102/307
2009/0133597 A1 * 5/2009 Moore ..... F42D 3/00 102/331

* cited by examiner

*Primary Examiner* — Bret Hayes
(74) *Attorney, Agent, or Firm* — Weide and Miller, LTD.

(57) ABSTRACT

A bladder for tamping explosives, the bladder having a reservoir with a sealable opening at a top end thereof, the reservoir being configured to hold an incompressible liquid, and an explosive retaining member disposed on a rear side of the reservoir, the explosive retaining member being configured to hold one or more explosives against the rear side of the reservoir.

11 Claims, 3 Drawing Sheets

BLADDER FOR TAMPING EXPLOSIVES

BACKGROUND

1. Field

The disclosed embodiments relate to tamping devices. More specifically, the disclosed embodiments relate to bladders for tamping explosives.

2. Related Art

Tamping is understood as the packing, flattening, or compressing of explosives in order to direct the force or energy from an explosive in a desired manner. For example, clay, sand, or dirt may be packed into a drill hole above an explosive to direct the force of the explosion into the rock or other material on which the explosives are being used.

Explosives may be used in a number of applications such as mining, law enforcement, construction, and the like where an object is to direct energy from explosives at a substrate to break up the underlying substrate. Often, traditional tamping methods in such applications are time consuming. Further, without adequate tamping, the size or number of explosives required increases, which may increase costs and create unnecessary safety risks. Accordingly, a more efficient method and device for tamping explosives is desired.

SUMMARY

Accordingly, a bladder for tamping explosives, a system for tamping explosives, and a method for tamping explosives have been developed according to the disclosed embodiments. In one embodiment, a bladder for tamping explosives is provided that includes a reservoir with a sealable opening at a top end thereof. The reservoir is configured to hold an incompressible liquid therein. The bladder further includes an explosive retaining member disposed on a rear side of the reservoir. The explosive retaining member may be configured to hold one or more explosives against the rear side of the reservoir.

In some embodiments, the explosive retaining member comprises a sleeve disposed along the rear side of the reservoir. In this instance, the sleeve and the rear side of the reservoir form a slot in which the at least one explosive is inserted. The sleeve may be configured such that the one or more explosives may slide within the slot when the reservoir is not filled with the incompressible liquid. When the reservoir is filled with the incompressible liquid, the one or more explosives are held tightly in position. In other embodiments, the explosive retaining member may comprise at least one of a fastener, a hook-and-loop connector, a snap, a buckle, a strap, and an elastic.

In other embodiments, the sealable opening may comprise a threaded closure and a cap to cover the threaded closure. The cap may be tethered to the threaded closure. The incompressible liquid to be disposed within the reservoir may be water. When the incompressible liquid within the reservoir is in a filled condition, the liquid extends around three sides of the one or more explosives to provide effective tamping.

In further embodiments, a system for tamping explosives is provided. The system may comprise a bladder that includes a reservoir having a sealable opening at a top end thereof. The reservoir may be configured to hold an incompressible liquid. The bladder also includes an explosive retaining member disposed on a rear side of the reservoir.

The system may further incorporate an energy transferring substrate disposed on a rear side of the bladder of the reservoir and at least one explosive. The explosive retaining member is configured to retain the at least one explosive and the energy transferring substrate against the rear side of the reservoir. The at least one explosive is preferably disposed between the rear side of the reservoir and the energy transferring substrate.

The explosive retaining member may comprise a sleeve disposed along the rear side of the reservoir. The sleeve and the rear side of the reservoir may define a slot in which the at least one explosive and the energy transferring substrate are inserted. The reservoir may comprise extensions at the top end and a bottom end thereof that extend beyond the sleeve.

The sleeve may be configured such that the at least one explosive and energy transferring substrate may slide within the slot when the reservoir is not filled with the incompressible liquid. When the reservoir is filled with the incompressible liquid, the at least one explosive and the energy transferring substrate are held tightly in position.

The energy transferring substrate is comprises at least one of a rubber member or a synthetic rubber member. The energy transferring substrate may be a long rectangular member or a square member. The bladder may be formed so as to tightly fit over the shape and size of the energy transferring substrate. When the incompressible liquid within the reservoir is in a filled condition, the liquid extends around three sides of the at least one explosive and the energy transferring substrate.

In another embodiment, a method for tamping explosives is provided. The method may comprise providing a bladder for tamping explosives. The bladder may include a reservoir having a sealable opening at a top end thereof, and an explosive retaining member disposed on a rear side of the reservoir. The method may also include positioning at least one explosive and an energy transferring substrate on the rear side of the reservoir. The at least one explosive may be disposed on the energy transferring substrate. The explosive retaining member is set to retain the at least one explosive and the energy transferring substrate against the rear side of the reservoir.

The method may further comprise filling the reservoir with an incompressible liquid, removing any excess air from reservoir, positioning the bladder against a surface of a target substrate, and detonating the at least one explosive. In the method, energy from the at least one explosive may be redirected towards the target substrate by the incompressible fluid stored within the reservoir.

The explosive retaining member may be any one of a sleeve, fastener, hook-and-loop connector, snap, buckle, strap, and elastic. The explosive retaining member may further comprise more that one of the above described retaining mechanisms. The explosive retaining member is configured such that the at least one explosive and the energy transferring substrate may slide relative to the rear side of the reservoir when the reservoir is not filled with the incompressible liquid. When the reservoir is filled with the incompressible liquid, the at least one explosive and the energy transferring substrate are held tightly in position.

In the method, filling the reservoir with an incompressible liquid causes the incompressible liquid to be disposed on three sides of the at least one explosive and the energy transferring substrate. This allows the explosive to be effectively tamped.

In the above described bladder, system, and methods, the explosive retaining member, such as the sleeve or other retaining member, allows quick and proper tamping of the explosives. For example, the bladder with the sleeve allows a non-explosive pushing medium or housing material (such as the recited energy transferring substrate) to be properly and easily tamped without the need for any adhesives. Further, proper placement of the tamping bladder around the explosives and non-explosive pushing medium is facilitated by the sleeve and bladder itself.

The unique design of the retaining member, such as the sleeve, allows the non-explosive pushing medium and/or housing material to simply slide in and become secure and ready for operational use once the bladder is filled with water. No adhesives or additional attachment or securing methods are required.

The above described bladders, systems, and methods provide among other advantages operational breaching with ease and simplicity of properly tamping a charge without the usual complexity associated with the fitting, adjusting, and attachment methods associated with conventional tamping. Further, in the event that the explosives are not used, the user may simply empty the water or other liquid out of the bladder and proceed to slide the bladder off of the non-explosive pushing medium and/or housing. The bladder may then be folded and stored for use with other explosives.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

The disclosed embodiments provide for a method of tamping explosives and a system and device for tamping explosives that increases tamping efficiency and reduces safety risks and costs by reducing the number of explosives required in a given application. It has been found that water, which performs essentially as an incompressible fluid, is particularly efficient at tamping an explosive to direct the energy of the explosive in a desired direction. Accordingly, the disclosed embodiments are directed to bladder and method of using a bladder filled with water or other incompressible liquid for tamping explosives.

Figure 1A:
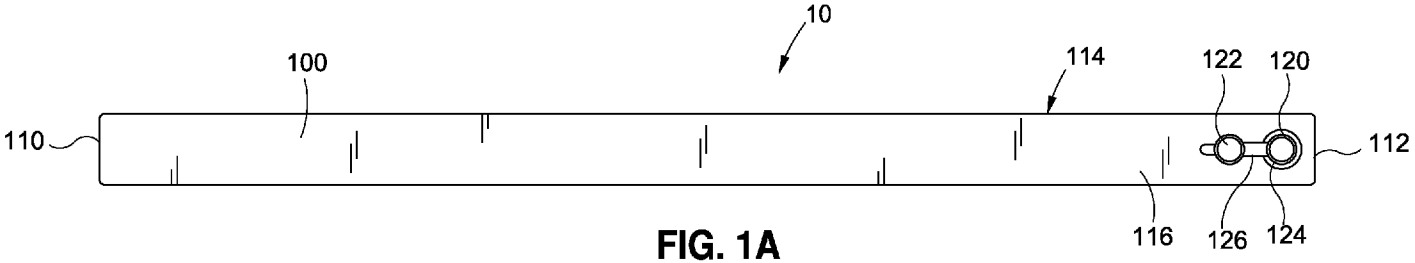
FIG. 1A shows a bladder for tamping explosives in an unfilled condition.
Figure 1B:
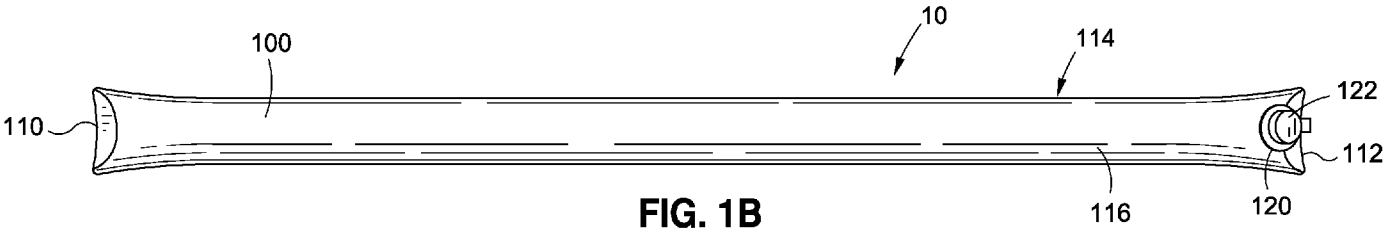
FIG. 1B shows the bladder of FIG. 1A in a filled condition, according to one exemplary embodiment.

FIG. 1A shows a bladder for tamping explosives in an unfilled condition, according to one exemplary embodiment, and FIG. 1B shows the bladder of FIG. 1A in a filled condition. In FIG. 1A, a bladder 10 for tamping explosives comprises a reservoir 100 that may be filled with a liquid, such as water. The reservoir 100 may be formed from a highly durable rubber, synthetic rubber, or other flexible plastics, such as materials commonly used for hydration reservoirs. In FIG. 1A, a left side of the bladder 10 is referred to as the bottom end 110 of the bladder 10, and the right side of the bladder 10 is referred to at the top end 112 of the bladder 10. The bladder 10 further comprises a front side 116 and a rear side 114 opposite the front side 116.

As shown in FIGS. 1A and 1B, the bladder 10 comprises an opening 120 for adding and/or removing liquids from the reservoir 100. The opening 120 comprises a resealable cap 122 that seals the opening 120. For example, the opening may comprise threaded closure 124 or other member of a sealable fastener that connects with the cap 122. The cap 122 may be connected to the threaded closure 124 by way of a tether 126.

As shown in FIG. 1B, the reservoir 100 of the bladder 10 may be filled with a liquid. For example, the reservoir 100 may be filled with water. The liquid is added to the reservoir 100 and retained within the reservoir 100 by way of the opening 120 and cap 122.

Figure 2:
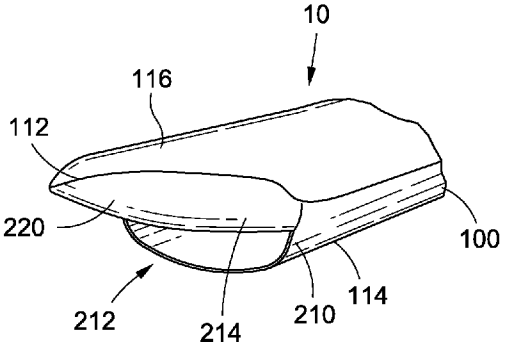
FIG. 2 shows a top end of a bladder for tamping explosives, according to one exemplary embodiment.

FIG. 2 shows a top end of a bladder for tamping explosives, according to one exemplary embodiment. As shown in FIG. 2, the rear side 114 of the bladder 10 has a sleeve 210 connected thereto. The sleeve 210 extends along the length of the bladder 10 from a top end 112 to a bottom end 110. At each end 110, 112 of the bladder 10, the reservoir 100 includes an extension 220 that extends beyond the sleeve 210. The sleeve 210 and a rear surface 214 of the reservoir 100 on the rear side 114 of the bladder 10 form a slot 212. The slot 210 is configured to house an explosive and an energy transferring substrate as described below.

Figure 3:
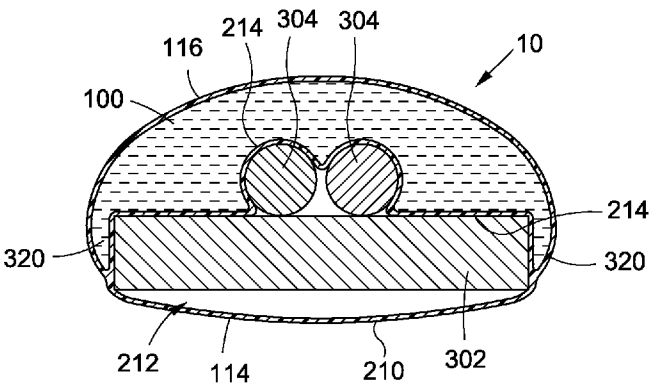
FIG. 3 shows a cross section view of a bladder for tamping explosives, according to one exemplary embodiment.

FIG. 3 shows a cross section view of a bladder for tamping explosives, according to one exemplary embodiment. In FIG. 3, the cross section view shows the bladder 10 described above in a filled condition with explosives 304 loaded into in the slot 212. Specifically, a non-explosive pushing medium or housing material (an energy transferring substrate) that is rubber member 302 in this embodiment is inserted into the slot 212. Explosives, such as detonation cords 304, are placed along a surface of the rubber member 302. The explosives 304 are positioned to be between the rubber member 302 and the rear surface 214 of the reservoir 100. Other types of explosives 304 may also be utilized.

The sleeve 210 is configured to allow the rubber member 302 and explosives 304 to slide into the slot 212 when the reservoir 100 is in the unfilled condition. That is, when the reservoir 100 is unfilled, the sleeve 210 allows sufficient space in the slot 212 for a user to insert and slide the energy transferring substrate and explosives into position. When the reservoir 100 is in the filled condition, the sleeve 210 tightly holds the rubber member 302 and explosives 304 in place. More specifically, when the reservoir 100 is filled, the space in the slot 212 narrows, and the energy transferring substrate and explosives are held in position. This is done without the use of any other fasteners or adhesives.

In FIG. 3, for purposes of explanation to show the rubber member 302 within the slot 212, the sleeve 210 appears loose. However, as explained above, the sleeve 210 fits snugly around the rubber member 302 when the bladder 10 is filled with water. Because of the tight fit formed by the filled reservoir 100, there is no need to use adhesives to hold the reservoir 100 in position relative to the explosives 304 and rubber member 302, and to hold the explosives 304 relative to the rubber member 302. Further, the sleeve 210 and reservoir 100 are constructed to properly position the rubber member 302 with the explosives 304 in the correct position when the reservoir 100 is filled. Thus, the user can easily place assemble the system in the proper manner. This reduces construction time, cost, the likelihood of distortion of the bladder caused by displacing water through the length of the rubber, and the risk of uneven and/or improper tamping.

The bladder 10 is configured to fit around the rubber member 302 and explosives 304 such that three sides of the rubber member 302 are surrounded by the water in the reservoir 100. Specifically, the reservoir 100 forms wrapped portions 320 that extend over the sides of the rubber member 302 when the reservoir 100 is filled with water. In other embodiments, other mechanisms instead of the sleeve 210 may be utilized to hold the rubber member 302 and explosives 304 tightly against the rear surface 214 of the reservoir 100. For example, a series of short sleeves or fasteners, such as hook-and-loop fasteners (Velcro), snaps, buckles, straps, elastics, or the like may be disposed along the length the rear surface 214 of the reservoir 100. The sleeve 210 or other described mechanisms may be referred to as an explosive retaining member herein. Importantly, the retaining member allows the energy transferring substrate and explosives to be easily and correctly positioned for efficient tamping.

FIGS. 4A, 4B, 4C, and 4D show a method of preparing a system for tamping explosives, according to one exemplary embodiment. First, in FIG. 4A, the rubber member 302 and explosives 304 are inserted into the slot 212 of the bladder 10. That is, the rubber member 302 and explosives 304 are inserted between the sleeve 210 and the reservoir 100 from one end of the bladder 10, such as the top end 112. To facilitate the loading of the rubber member 302 and the explosives 304, the reservoir 100 is in an unfilled condition. When the reservoir 100 is unfilled, the rubber member 302 and the explosives 304 may easily slide through the slot 212. Accordingly, the user may grasp the extension 220 to help guide the rubber member 302 and explosives 304 into the slot 212.

Figure 4A:
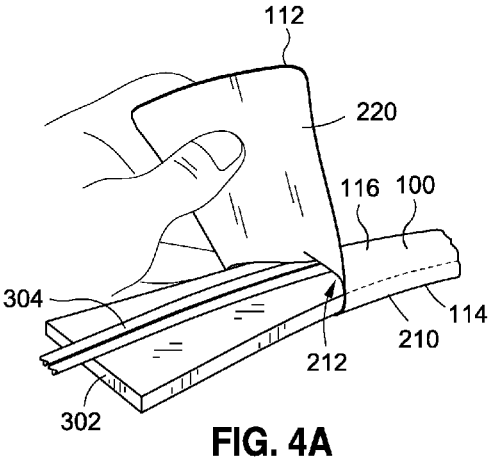
FIGS. 4A, 4B, 4C, and 4D show a method of preparing a bladder for tamping explosives, according to one exemplary embodiment.
Figure 4B:
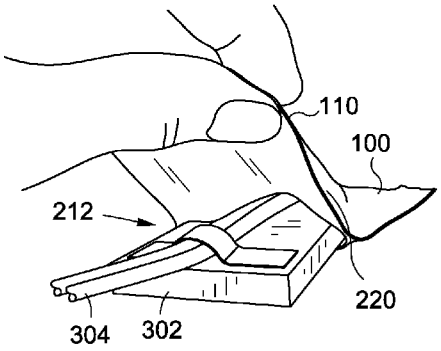

Next, as shown in FIG. 4B, the rubber member 302 and explosives 304 are advanced through the slot 212 to fill the length of the slot 212. It is noted that the bladder 10 is sized to fit the desired rubber member 302 and explosives 304. In this embodiment, the rubber member 302 is a two-inch wide, three ply conveyer belt rubber strip. However, other shapes and sizes of a rubber member 302 may be used. The bladder 10 may thus also be sized to fit the differently shaped rubber members 302. For example, a square rubber member and bladder may be used, such as for an eight by eight inch or a twelve by twelve inch rubber member. A one inch wide elongated rubber member might also be utilized. Of course, the above examples are merely exemplary, and any desired shape and size may be incorporated based on the desired application.

Figure 4C:
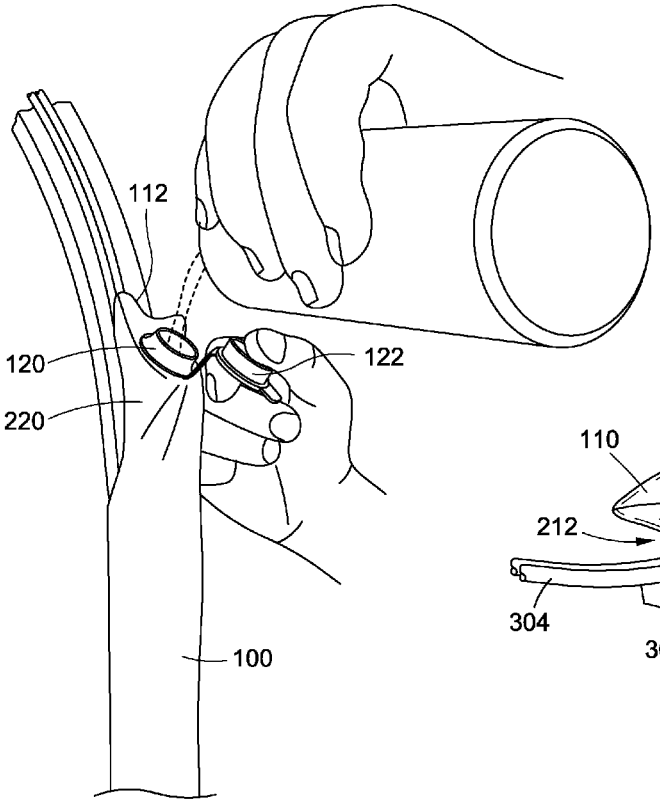

In FIG. 4C, with the rubber member 302 positioned as desired within the sleeve 210, water is added to the reservoir 100 via the opening 120. Preferably, the water is added while the reservoir 100 is positioned vertically with the top end 112 directed upwards. In this position, the reservoir 100 may be filled to the desired level, and all excess air can easily and reliably be removed from the reservoir 100. Once the reservoir 100 is filled and the excess air is removed, the cap 122 is closed down onto the opening 120 and is sealed. The seal may be accomplished by way of an o-ring disposed on an interior of the cap 122, and/or may be reinforced by an adhesive or tape surrounding the cap 122. Optionally, the extensions 220 may be folded over to provide additional sealing of the reservoir 100.

Figure 4D:
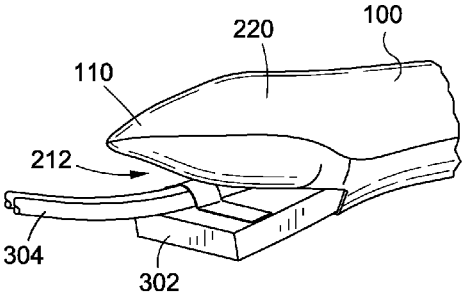

FIG. 4D shows the completed assembly from the bottom end 110 with the reservoir 100 in the filled condition. In this condition, the bladder 10 is ready to be utilized to effectively tamp the explosives. Specifically, as described above with reference to FIG. 3, the reservoir 100 surrounds three sides of the rubber member 302 and explosives 304 within the slot 212.

Figure 5:
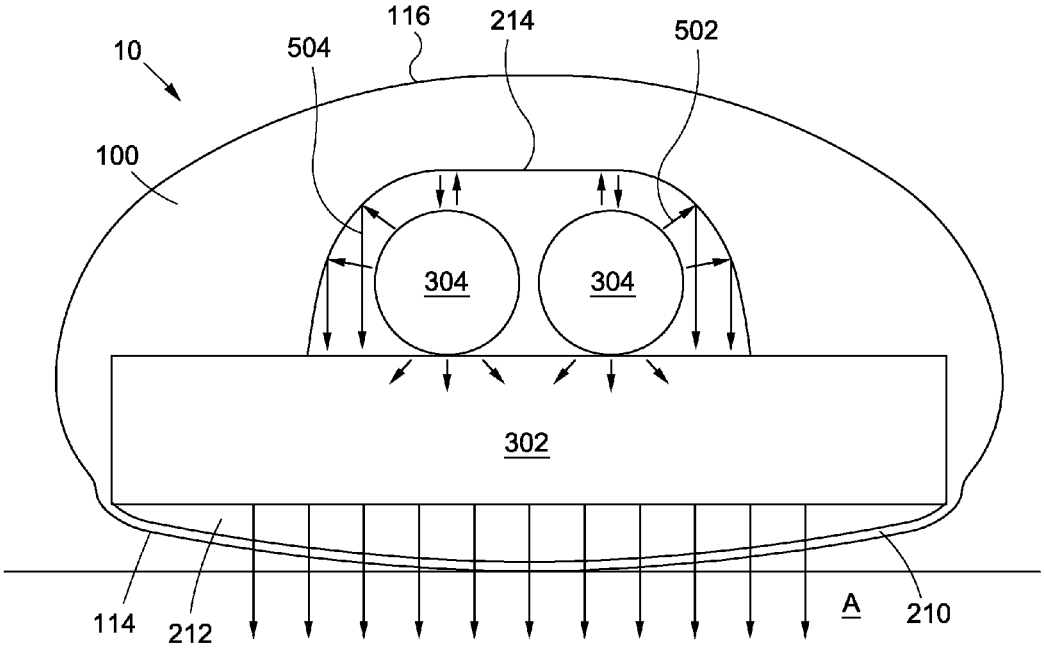
FIG. 5 shows a cross section diagram of a method of tamping explosives using a bladder, according to one exemplary embodiment.

FIG. 5 shows a cross section diagram of a method of tamping explosives using a bladder, according to one exemplary embodiment. As explained above, the water within the bladder 10 performs as an incompressible fluid to tamp the explosives 304. In a method of tamping explosives, a bladder 10 described above is utilized along with explosives 304 and a rubber member 302 as shown, for example, in FIG. 3. The system of the bladder 10, rubber member 302, and explosives 304 are then placed against a substrate A. The substrate A is the target at which the energy from the explosives is directed.

With this system, when the explosives 304 are detonated, the energy of the explosives is directed outwardly from the explosives as indicated by the arrows 502 in FIG. 5. Some of the energy is thus initially directed towards the inner surface 214 of the reservoir 100. The water within the reservoir, being a substantially an incompressible fluid, redirects the energy back towards the rubber member 302, as shown by the arrows 504. Due to the redirection of the energy caused by the tamping, a large portion of the energy from the explosives 304 is directed or redirected away from the front surface 116 and towards the rear surface 114 of the bladder 10. The rubber member 302 transfers the energy to the target substrate A. When a sufficient amount of energy is transferred, the energy breaks up or breaches the substrate A. The substrate A may be a lock, a door, or a wall in the case of a military or law enforcement application, or may be a solid rock layer in a construction or mining application.

The bladder 10 as described in the above embodiments provides a number of advantages. The bladder 10 provides a superior design and exact fit for a corresponding rubber member 304. Accordingly, as compared to traditional tamping methods, it has been found that a breaching system utilizing the bladder 10 may reduce the net explosive weight ("N.E.W.") required for breaching various targets by as much as 75%. Accordingly, there is a significant reduction in the levels of hazardous blast pressure released into the ambient environment due to the reduction of the N.E.W. and by the water tamping design itself. This combination of reduced N.E.W. and blast pressure assures minimization of collateral damage in confined or enclosed spaces. Further, the soft construction of the bladder 10 coupled with the use of water as the tamping medium results in low hazard debris projecting back in the breather's direction and/or into the surrounding environment.

In the above described bladder, system, and methods, the explosive retaining member, such as the sleeve or other retaining member, allows quick and proper tamping of the explosives. For example, the bladder with the sleeve allows a non-explosive pushing medium or housing material (such as the recited energy transferring substrate) to be properly and easily tamped without the need for any adhesives. Further, proper placement of the tamping bladder around the explosives and non-explosive pushing medium is facilitated by the sleeve and bladder itself.

The unique design of the retaining member, such as the sleeve, allows the non-explosive pushing medium and/or housing material to simply slide in and become secure and ready for operational use once the bladder is filled with water. No adhesives or additional attachment or securing methods are required.

The above described bladders, systems, and methods provide among other advantages operational breaching with ease and simplicity of properly tamping a charge without the usual complexity associated with the fitting, adjusting, and attachment methods associated with conventional tamping. Further, in the event that the explosives are not used, the user may simply empty the water or other liquid out of the bladder and proceed to slide the bladder off of the non-explosive pushing medium and/or housing. The bladder may then be folded and stored for use with other explosives.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A system for tamping explosives, the system comprising:

a bladder including:

a reservoir having a sealable opening at a top end thereof, the reservoir being configured to hold an incompressible liquid, and a sleeve disposed on a rear side of the reservoir;

an energy transferring substrate; and at least one explosive, wherein the sleeve is configured to retain the at least one explosive and the energy transferring substrate against a rear side of the reservoir, and the at least one explosive is disposed between the rear side of the reservoir and the energy transferring substrate, the reservoir comprising wrapped portions that extend at least partially around the energy transferring substrate.

2. The system for tamping explosives according to claim 1, wherein the sleeve and the rear side of the reservoir form a slot in which the at least one explosive and the energy transferring substrate are inserted.

3. The system for tamping explosives according to claim 2, wherein the sleeve is configured such that the at least one explosive and the energy transferring substrate are configured to slide within the slot when the reservoir is not filled with the incompressible liquid, and the at least one explosive and the energy transferring substrate are held in position when the reservoir is filled with the incompressible liquid.

4. The system for tamping explosives according to claim 1, wherein the reservoir comprises extensions at the top end and a bottom end thereof that extend beyond the sleeve.

5. The system according to claim 1, wherein the energy transferring substrate comprises at least one of a rubber member or a synthetic rubber member.

6. The system according to claim 1, wherein the energy transferring substrate is a long rectangular member.

7. The system according to claim 1, wherein the energy transferring substrate is a square member.

8. The system according to claim 1, wherein the incompressible liquid within the reservoir in a filled condition extends around three sides of the at least one explosive and the energy transferring substrate.

9. A method for tamping explosives, the method comprising:

providing a bladder for tamping explosives comprising:

a reservoir having a sealable opening at a top end thereof, the reservoir being configured to hold an incompressible liquid, and a sleeve disposed on a rear side of the reservoir;

positioning at least one explosive and an energy transferring substrate on the rear side of the reservoir, the at least one explosive being disposed on the energy transferring substrate, and the sleeve retaining the at least one explosive and the energy transferring substrate against the rear side of the reservoir;

filling the reservoir with an incompressible liquid, the reservoir comprising wrapped portions that extend at least partially around the at least one explosive and the energy transferring substrate when the reservoir is filled;

removing any excess air from reservoir;

positioning the bladder against a surface of a target substrate; and detonating the at least one explosive, energy from the at least one explosive being redirected towards the target substrate by the incompressible liquid stored within the reservoir.

10. The method according to claim 9, wherein the sleeve is configured such that the at least one explosive and the energy transferring substrate are configured to slide relative to the rear side of the reservoir when the reservoir is not filled with the incompressible liquid, and the at least one explosive and the energy transferring substrate are held in position when the reservoir is filled with the incompressible liquid.

11. The method according to claim 9, wherein filling the reservoir with an incompressible liquid causes the incompressible liquid to be disposed on three sides of the at least one explosive and the energy transferring substrate.

* * * * *